United States Patent [19]

Balka, Jr.

[11] 4,207,857

[45] Jun. 17, 1980

[54] AUTOMATIC BALL SERVER

[76] Inventor: William J. Balka, Jr., 1120 Prospect St., Westfield, N.J. 07090

[21] Appl. No.: 906,925

[22] Filed: May 18, 1978

[51] Int. Cl.[2] ..... F41F 1/04

[52] U.S. Cl. ..... 124/56; 124/41 C; 124/50

[58] Field of Search ..... 124/41 R, 41 C, 50, 124/56, 71; 273/26 D, 29 A, 30

[56] References Cited

U.S. PATENT DOCUMENTS

| | | | |
|---|---|---|---|
| Re. 28,096 | 8/1974 | Earle, Jr. et al. | 273/26 D X |
| 3,905,349 | 9/1975 | Nielsen et al. | 124/41 C X |
| 4,027,646 | 6/1977 | Sweeton | 124/56 |
| 4,046,131 | 9/1977 | Clark et al. | 124/71 |
| 4,094,294 | 6/1978 | Speer | 124/56 |

*Primary Examiner*—Richard T. Stouffer
*Attorney, Agent, or Firm*—H. Hume Mathews

[57] ABSTRACT

Automatic ball serving apparatus for serving, lobbing, volleying or smashing balls, such as tennis balls, for practice purposes wherein two cans or buckets are vertically stacked to form a lower generally cylindrical compressed air chamber and an upper generally cylindrical ball feed chamber, a ball firing barrel outside said lower bucket connected to both said ball feed chamber and to said compressed air chamber so that balls fed into said firing barrel will be fired therefrom by the compressed air in said lower chamber, and a stand for oscillating said apparatus while balls are being fired from said barrel so that the trajectories of different balls will lie in different directions.

2 Claims, 5 Drawing Figures

AUTOMATIC BALL SERVER

BACKGROUND OF THE INVENTION

The present invention is in the field of automatic tennis ball serving machines. Such machines are used for practice purposes. A single player, wishing to improve his game, can place a large number of balls in the feed bin of the machine and then, after flipping a switch which turns the machine on, retire a selected distance away from the machine and be served automatically with balls projected from the machine one after another, fast or slow, lobs, volleys or smashes, in different directions.

Many such machines are known in the prior art, for example as disclosed in Nielson and Church U.S. Pat. No. 3,905,349 issued Sept. 16, 1975; Torbet U.S. Pat. No. 4,021,037 issued May 3, 1977; and Sweeton U.S. Pat. No. 4,027,646 issued June 7, 1977. However, none of the prior art machines is completely satisfactory in all respects. They are either too large and too heavy if they perform well or else, if small and light, are of only very limited performance. It has become necessary to invent improved apparatus which will obviate these deficiencies of the said prior art apparatus. In particular, lighter, more portable and compact and less expensive apparatus, which will do the same things as well or better than the large and heavy type machines of the prior art, but with much less machine weight, much less machine cost, and considerably greater portability, are needed to fulfill the needs of the potential market. This invention meets those needs.

SUMMARY OF THE INVENTION

According to the present invention, an automatic ball throwing machine is formed of two cans or buckets, stacked vertically with their longitudinal axis in alignment to form an upper generally cylindrical ball storage and feed chamber and a lower generally cylindrical compressed air chamber. The two buckets can be of a type manufactured in large volume for other uses, i.e. storage and shipment of liquids of various kinds, and thus are available commercially at very low cost. For example, in the presently preferred embodiment of the invention, described hereinbelow, the air chamber is made from a five gallon bucket and the ball feed chamber from a three gallon bucket. A conventional vacuum cleaner motor and air compressor, manufactured in large volume for vacuum cleaners and thus available commercially at low cost is used to supply compressed air to the lower chamber. These basic components are assembled with other components on a stand which oscillates them during serving operations, to form a novel combination which, although simple, results in a complete automatically operable apparatus that provides the same or better performance as prior designs but in a way which greatly reduces the manufacturing cost (and therefore the sales price) of the machine. The new design of this invention not only allows lower cost components to be used (as compared to the prior art machines) but also simplifies their assembly and thus reduces the time and cost of assembly.

The apparatus takes balls to be served from the upper feed bucket and delivers them to a firing barrel on the outside of the two buckets which form the main body of the machine, by means including a ball feed tube of a design adapting the same to be manufactured of plastic material in large volume at low cost, for example by injection molding. This ball feed tube extends from a ball feed port in the top of the lower bucket to and through an opening in the side wall of the lower bucket, where it is connected by a flexible tube to the inlet end of the firing barrel. Compressed air from the chamber in the lower bucket is fed into the ball feed tube through a vent or port in its lower wall, in the nature of a flap which directs the air flow in the direction of ball movement through the feed tube, thus facilitating the movement of the balls from the ball feed chamber through the feed port and through the ball feed tube to a detent at the inlet end of the firing barrel, where the balls are arrested and retained until the pressure of the air which fires them through the firing barrel is built up to the selected firing pressure.

Automatic ball feeding mechanism, which can be rotated by a low cost electrical motor to feed balls successively through the ball feed port, is located in the upper bucket. The air compressor is located in the lower chamber and discharges the air it compresses directly into said chamber.

A check valve maintained in open position by gravity, is so mounted just beneath the ball feed port as to close automatically when the direction of flow of air in the feed tube is "reversed" following the arrest of a ball by the detent at the inlet end of the firing barrel, thus enabling the pressure in the compressed air chamber and the pressure of the air exerted against the ball while the same is retained by the detent, to be built up to the selected value at which the ball will be forced past the detent and discharged through the firing barrel, out of its muzzle, and into a trajectory which ends in the space or area into which the ball is to be served.

The rotational speed of the ball feeding mechanism in the upper bucket is deliberately made different from the rotational speed of the oscillating mechanism in the bottom stand, so that the balls will be fired in random directions and not always at the same firing barrel positions.

DESCRIPTION OF THE PREFERRED EMBODIMENT

Figure 1:
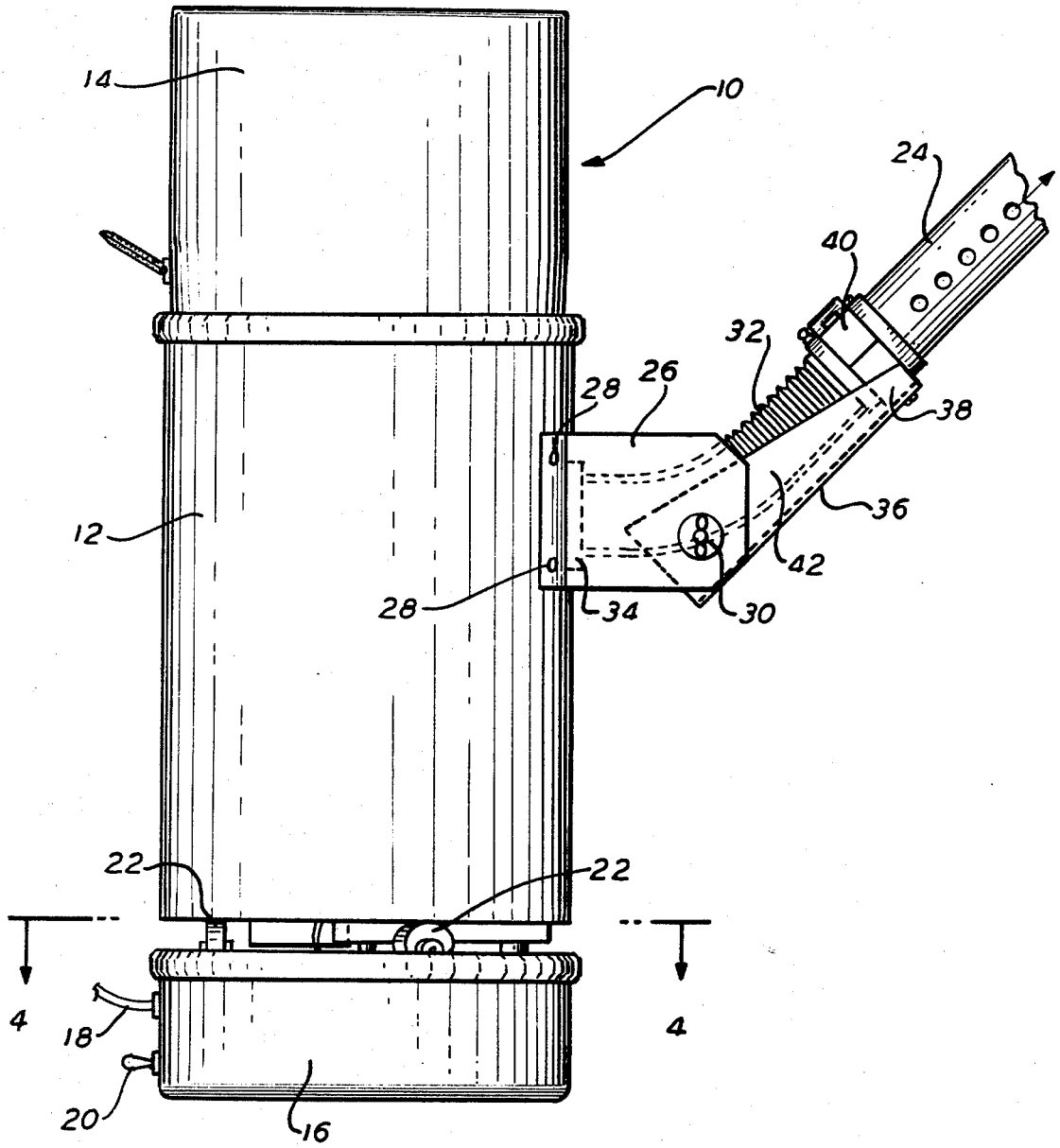
FIG. 1 is a front elevation of a preferred form of an automatic ball throwing machine constructed in accordance with the present invention.

Referring to FIG. 1, the presently preferred embodiment of the automatic ball throwing machine 10 of the present invention comprises three main components, a compressed air bucket 12, a ball storage and feed bucket 14, and a base or stand section 16 which support and also oscillate during operation the air and feed buckets about their vertical axis.

Power to operate the apparatus, including an air compressor motor and a ball feed motor in bucket 12, and an oscillating motor in stand 16, is supplied through an electrical lead 18. A three position switch 20 controls the flow of electricity to the three motors. In one switch position all motors are off and the machine is inoperative. In a second switch position, the air compressor motor and the ball feed motor in bucket 12 will be running, with the result that the machine will be operating and automatically firing (or serving) balls but always in the same direction, without oscillation.

In the third switch position, the two motors referred to above will both be running and in addition, a third motor, in the stationary stand 16, will also run and will cause the upper and lower buckets 14 and 12 to oscillate, as a unit, on the rollers 22 carried on top of the stationary base or stand 16. Thus, the ball firing barrel 24 carried by the lower bucket 12 will also be oscillated, from side to side about the vertical axis of the two buckets, and the balls fired from said barrel will be projected in trajectories which lie in different directions.

Still referring to FIG. 1, the firing barrel 24 is carried or mounted on two side by side spaced brackets 26, the nearer one of which is shown in FIG. 1. These brackets are permanently and rigidly attached, as by rivets 28 to the side wall of bucket 12. However, the firing barrel 24 is adjustably mounted on said brackets, so that it can be adjusted to change its elevation in a vertical plane, about two pivot pins with locking wing nuts (the nearer one of which is shown at 30 in FIG. 1) the arrangement being such that when the wing nuts are loosened, the firing barrel 24 can be raised or lowered about pivots 30 to the particular firing elevation desired and then fixed in that position by tightening the wing nuts, thus locking the firing barrel in the selected elevational position. A flexible, corrugated, hose or tube 32 is used to connect the inlet or chamber end of firing barrel 24 to a ball feed tube which is located within bucket 12 and which extends through an opening in the side wall thereof. The connection between the corrugated hose and the end of the ball feed tube is at location 34 in FIG. 1. A sheet metal bracket 36 of U-shaped cross-section is rigidly secured at 38 to a socket member 40 attached to the outer end of flexible tube 32. The two upstanding wings of this bracket, the near one of which is shown at 42 in FIG. 1, are nestled or telescoped within the two fixed, spaced, brackets 26 and are pivoted thereto by the pivots 30. Thus, the U-shaped movable sheet metal bracket 36 can be pivotally adjusted about the horizontal axis of the pivots 30 with respect to the fixed bracket 34 and then locked in the desired adjusted position by tightening wing nuts 30.

Flexible connector tube 32 connected at one end to the socket member 40 carried by the outer end of the movable bracket 36 and at the other end (location 34) to the ball feed tube enables the firing barrel 24 to be adjusted in elevation, in the manner just described, to vary the angular position of the firing barrel 24 with respect to the horizontal plane.

Figure 2:
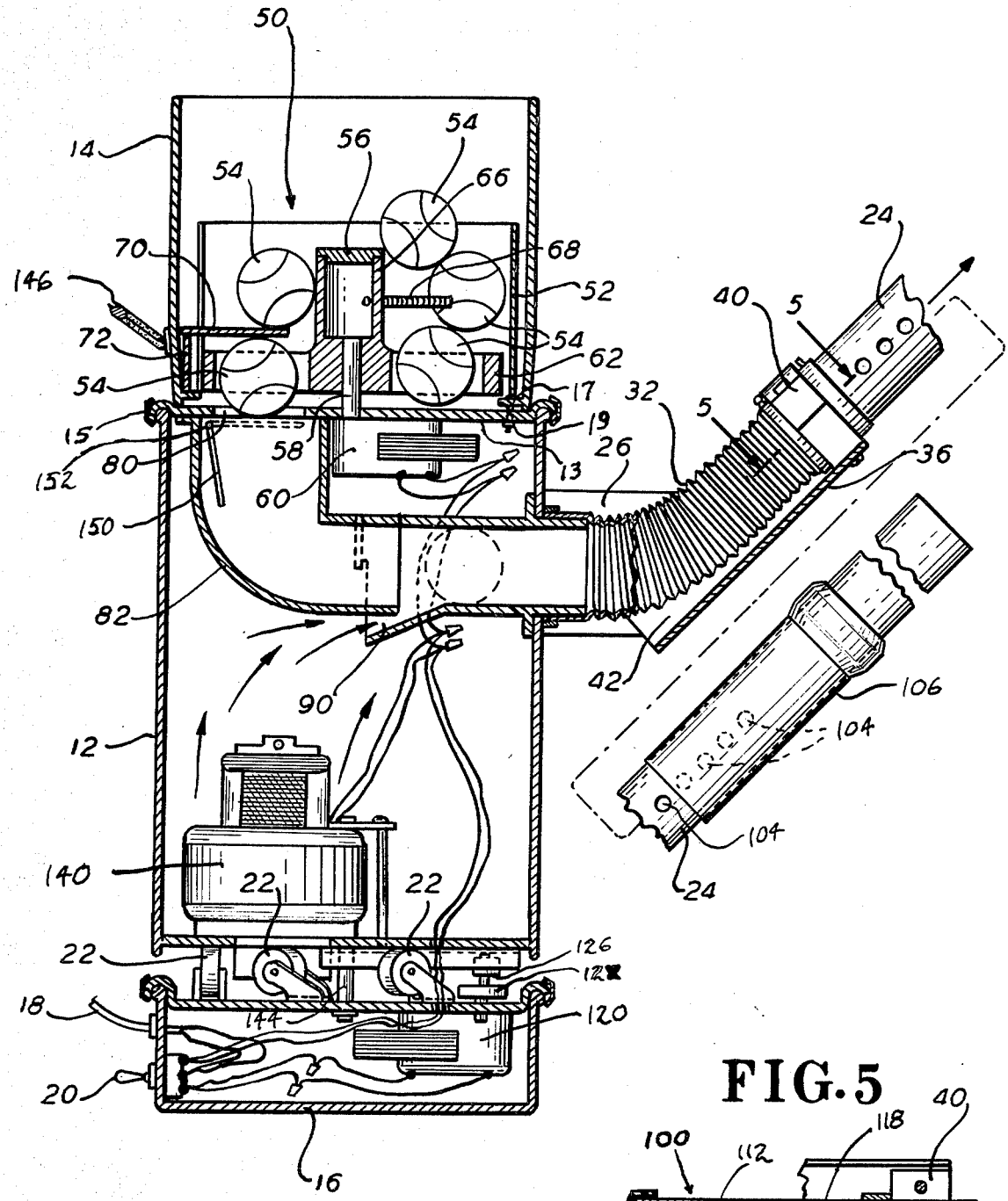
FIG. 2 is a vertical cross-section along the lines 2—2 in FIG. 3, of the machine shown in FIG. 1, with some components, including the firing barrel and the air motor and pump, being shown in elevation.
Figure 3:
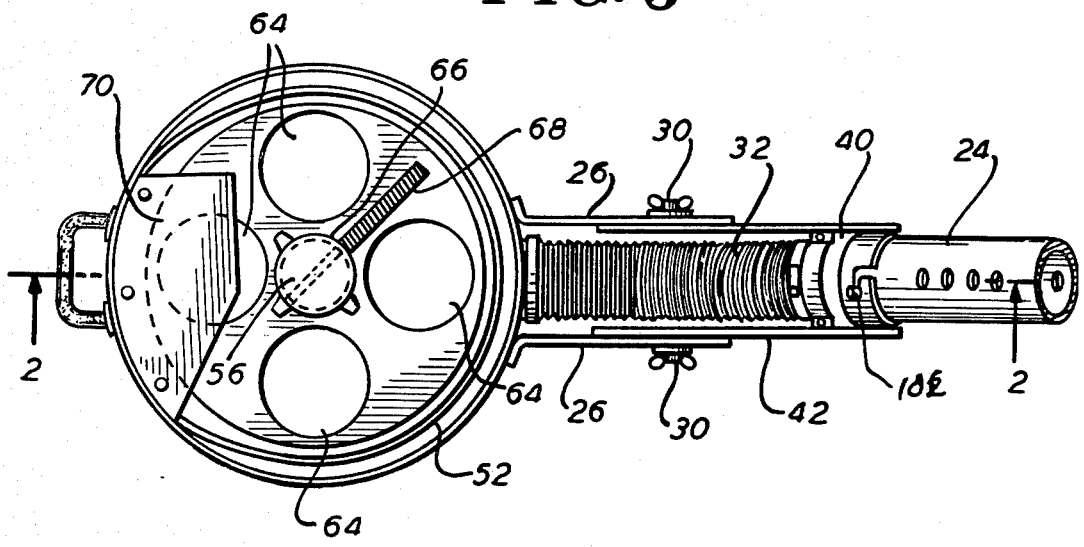
FIG. 3 is a top or plan view of the machine of FIG. 1.

Referring now to FIG. 2, upper bucket 14 has mounted therein a ball feed mechanism 50 which comprises a cylindrical portion 52 made of a stiff, flexible material such as sheet fiber. The two ends of this partial cylinder abut against a horizontal ball guide plate 70, as best seen in FIG. 3. Within this fiber cylinder 52 is a rotor 56 carried by the rotating drive shaft 58 of the electrical motor 60 in bucket 12. Rotor 56 includes a metal disc 62 which has holes therein spaced circumferentially around its axis of rotation (in this case four holes as shown in FIG. 3) and into which the balls 54 drop as shown in FIG. 2, upon rotation of the rotor by motor 60. The hub part 66 of the rotor carries a sweep arm 68 which, upon rotation of the rotor and the sweep arm carried thereby, moves the balls in the fiber hopper 52 so that they fall into the holes in disc 62 of rotor 56 and are rotated therewith around the axis of the rotor. The guide plate 70 fixed to the upper bucket wall at 72, and which has a horizontally extending portion projecting into the path of balls 54 as they are moved by rotation of the rotor 56 and sweep arm 68, causes one ball at a time to be present in a rotor hole 64 as the respective hole passes under the guide plate 70, and also separates the said ball in said hole while in said location from any other balls in hopper 52 which may be in higher positions, i.e. above said guide plate.

As will best be seen in FIG. 2, the lower bucket 12 is provided with a top cover 13, retained thereon in airtight relationship by "C" clamp 15. The bottom of the upper bucket 14 is mostly removed, except for a portion 17 around the inside circumference which forms an inwardly projecting ledge to which bolts 19 can be secured to fasten the top bucket to the cover 13 of the bottom bucket.

An opening 80 is provided in the cover, or top wall of the lower bucket, connecting the upper bucket with the inlet of ball feed tube 82. The ball feed tube extends from said opening 80 first downwardly and then horizontally through the lower bucket and then through an opening in the side wall of the lower bucket, where it connects at location 34 with the inner end of flexible tube 32.

Opening 80 lies beneath guide plate 70 and is so placed as to match exactly, and to be co-axial with, the respective holes 64 in the rotor disc 62 as the same are successively brought under guide plate 70 by rotation of rotor 56.

When a hole 64 in rotor disc 62 containing a ball 54 does reach the position co-axial with the opening 80 in the bottom wall of upper bucket 14, the ball drops through the opening 80 and into the ball feed tube 82. It then falls or rolls on down and around the elbow section of tube 82 and into the horizontal portion of the tube, at which point it is "picked up" or moved by the flow of air passing into the feed tube through opening 90 in its lower wall, as shown by the arrows in FIG. 2, and then forced by said air flow on through the feed tube, through flexible connector 32, until it butts against and is arrested by the detent 100 at the outer end of flexible tube 32, as shown in FIG. 5.

The firing barrel 24 is attached by a bayonet/slot connection 102 (See FIG. 3) to the socket 40, so that it may easily be removed for shipment or storage or placed in firing position, at will. The barrel is provided with a series of longitudinally spaced holes 104 which may be covered, to a greater or lesser extent, by longitudinal movement of a sleeve 106 that is slidably mounted on the outside of the barrel (See FIG. 2).

Figure 5:
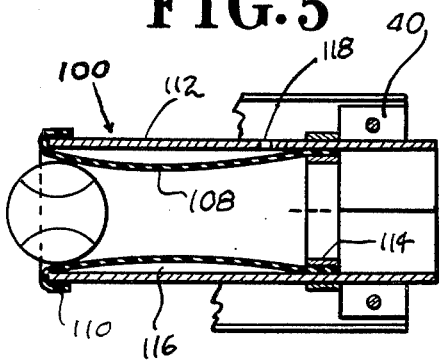
FIG. 5 is a cross-sectional view along the lines 5—5 in FIG. 2, showing the construction of the detent device at the inner, or "chamber" end of the firing barrel.

Detent 100, as shown in FIG. 5, is formed of a cylindrical elastic sleeve 108, which may be made of rubber sealed at the turned over edge 110 to the cylindrical metal nipple 112 extending inwardly from socket 40. The sleeve is also scaled within the nipple at its outer end by an internal sealing ring 114. The elastic sleeve is venturi shaped internally along its length, and a space 116 forming a fluid tight chamber surrounds the sleeve intermediate its ends. A fluid flow restriction, or bleed hole of selected diameter, is provided at 118 in the wall of nipple 112 so that air in chamber 116 will flow into, or out of, the chamber only at a selected or controlled rate of flow. An adjustable bleed valve (not shown) may be provided to vary the flow restriction of bleed 118 if desired, as is known in the art. The internal diameter of sleeve 108 under normal conditions (i.e. sleeve unexpanded with air at ambient pressure in chamber 116) is smaller than the external diameter of the balls which pass through the detent 100. Therefore, when a ball reaches the inner end of the detent, as shown in FIG. 5, its movement is arrested and the ball is wedged into the entrance of the detent thus not only stopping the ball, but also sealing the air passageway so no air can escape past the ball and out the firing barrel. At the same time, the expansion action of the ball on elastic sleeve 108 expands the sleeve and contracts the chamber space 116, thus causing the air therein to be compressed and to start to flow out through bleed hole 118.

If the pressure tending to force the ball through the detent is then increased, over a period of time, there will come a point at which the expelling force on the ball exceeds the arresting force on the ball. When this happens, the design is such that the ball will be ejected through the detent, expanding the elastic sleeve against the now reduced air pressure in chamber 116 as the ball is forced through the sleeve. The arrangement is such that each ball, in turn, is stopped by detent 100 until the air pressure behind the ball builds up to the desired firing pressure. At that point, the ball is in effect "released" by the detent and fired, with great force, through the firing barrel, out of its muzzle, and into a trajectory that ends in the players "return" area.

In order to simulate as nearly as possible actual playing conditions, buckets 12 and 14 are mounted on a stand (which may also be an inexpensive commercial can, of smaller size than the two buckets) that contains a motor 120 for oscillating mechanism located between the bottom of bucket 12 and the top of the stand.

Figure 4:
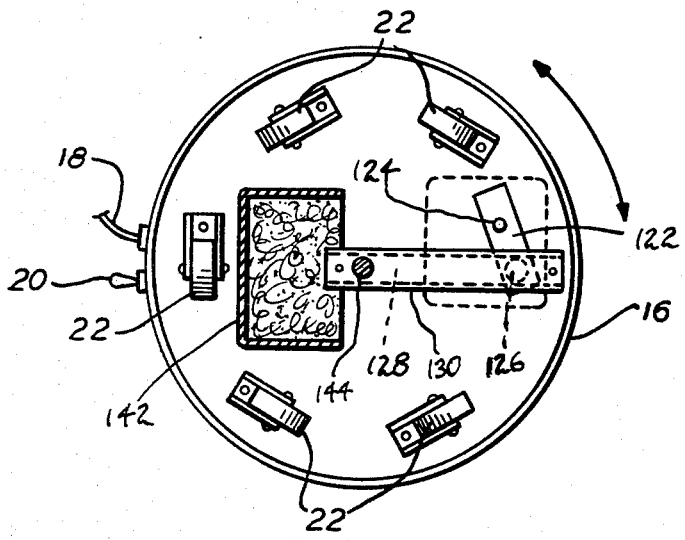
FIG. 4 is a top or plan view of the stand or base on which the compressed air and ball feed buckets are set and which contains the mechanism for rotating the two buckets and the firing barrel back and forth during operation so that the balls will be fired in varying or different directions of travel.

This mechanism (See FIG. 4) comprises a link 122 mounted on motor shaft 124 and which carries a roller 126 lying in a slot 128 of an arm 130 of U-shaped cross-section fastened to the bottom wall of bucket 12, with the longitudinal axis of the arm extending radially with respect to the vertical axis of the bucket. The arrangement is such that when motor shaft 124 rotates, link 122 also is rotated and this causes roller 126 to move arm 130 first in one direction of rotation through a predetermined angle of rotation and then back in the other direction of rotation to its original position. In other words, the arm (and therefore the buckets and the firing barrel attached thereto) are oscillated about their vertical axis. Rollers 22 fixed on the top cover of stand 16 and having rollers on which rest the bottom wall of bucket 12 enable this oscillation to take place easily and without undue friction.

As previously stated, the air compressor and its motor are mounted in bucket 12. This is shown generally at 140. The air inlet to the compressor is through an opening in the bottom wall of bucket 12, and an air filter 142 is preferably provided to keep foreign matter out of the compressor. The stand 16 is secured to bucket 12 by a central bolt 144. The cover on the stand 16, like the cover on bucket 12, is secured in place by a "C" clamp 15. A handle 146 enables the entire apparatus to be carried easily from place to place.

A pressure operated check valve 150, which normally hangs open by the force of gravity, is arranged to close and seal the opening 80 when pressure builds up in bucket 12 under conditions that would allow back-flow of air through tube 82 and out opening 80.

OPERATION

A bunch of balls (for example about 50 or so) are dumped into bucket 14 and the machine is turned on by switch 20, for either oscillating or non-oscillating operation as may be preferred. Rotor 56 turns until a ball in a hole 64 of the rotor comes into alignment with opening 80 in the top cover of the bucket 12. The ball then drops through the opening, passes through feed tube 82, and is forced into sealing engagement with detent 100 by the pressure of air transmitted from the compressed air chamber within bucket 12 through vent 90 and into ball feed tube 82. When the ball is thus arrested in its movement, and the outflow of air through firing barrel 24 thus stopped, the air flow will "back-up" sufficiently to cause check valve 150 to be forced upwardly about its pivot 152 to the horizontal position, in which it seals the opening 80 and thus prevents back flow of air out said opening.

In this stage of operation, both the entrance and exit openings of the compressed air chamber provided by bucket 12 are sealed, so air pressure is built up in said chamber by compressor 140 as it continues to run.

When the air pressure in bucket 12 reaches a predetermined value, determined primarily by the design of detent 100, the ball arrested by the detent is forced therethrough and ejected, or fired forcefully (for example at speeds of from 20 to more than 55 miles per hour), out the firing barrel 24. Timing of the firing of successive balls can be controlled by the rate of rotation of rotor 56. For example successive balls could be fired at 3½, 7, or 14 seconds, simply by plugging one or more of the holes 64 in rotor 56. With all holes open and a rotor speed which feeds a ball every 3½ seconds, a ball feed of one every 7 seconds can be achieved simply by plugging two opposite holes 64 in the rotor so that only two, rather than four, balls are fed for each revolution of the rotor. Plugging three holes would give a firing period of one every fourteen seconds because under such conditions, only one ball would be fed for each rotor revolution.

As previously stated, the oscillating mechanism may be turned on or off independently of the firing operation, as the operator may elect. However, if used, it is preferred that the rotational speed of the oscillating motor 120 be different than the rotational speed of feed motor 60. By so doing, the balls will be fired in random directions because the time of firing will not occur at the same place in the path of oscillation in successive cycles of operation.

Additional adjustment of the ball propelling force is provided by moving sleeve 106 up or down the firing barrel to cover or uncover, as the case may be, more or less of the holes 104 in the firing barrel wall. These holes, if uncovered, permit the escape of some of the compressed air and thus can be used to vary the discharge speed of a ball from the firing barrel.

I claim:

1. In a ball serving machine, a generally cylindrical compressed air chamber adapted to be placed on the ground or other supporting surface so that its longitudinal axis extends vertically when the machine is placed in operating position, an air compressor in said chamber for pressurizing said chamber, a ball discharge conduit in said chamber, said conduit having a vertical section secured to the top wall of said chamber, a horizontal section secured to and extending through the side wall of said chamber, and an elbow section forming a smoothly curved junction between said vertical and horizontal conduit sections for facilitating the passage of balls therebetween, said conduit providing a continuous ball rolling surface through said chamber except for an air injector port in the horizontal section of said conduit directly connecting said conduit with said chamber so that compressed air from said chamber is discharged through said port and into said conduit in the direction of ball passage therethrough, an opening in the top wall of said chamber within the confines of the vertical section of said conduit for enabling balls to be dropped from a ball compartment secured to the top of said chamber through said opening and into said conduit, said ball compartment having its upper end open to the atmosphere and being sealed off from said chamber except through said opening, a flap valve in said conduit for sealing said opening adapted automatically to open for the passage of balls from said ball compartment into said conduit and to close in response to an increase of air pressure in the vertical section of said conduit above the air pressure in said ball compartment, a ball firing barrel connected to said conduit outside said chamber containing a detent against which a ball passing into said firing barrel becomes lodged in fluid tight relationship until the air pressure behind said ball increases to a level wherein the ball is forced past said detent and fired through said firing barrel, and means in said ball compartment for successively feeding balls therein through said opening and into said conduit.

2. A ball serving machine according to claim 1, including a bottom section which carries a mechanism for rotating the upper and lower compartments and the firing barrel attached thereto first in one direction of rotation and then in the other direction of rotation about said axis.

* * * * *